US008770441B2

(12) United States Patent
Macler

(10) Patent No.: US 8,770,441 B2
(45) Date of Patent: Jul. 8, 2014

(54) MULTIPLE CHANNEL SINGLE SPIKE FOR A LIQUID DISPENSING SYSTEM

(71) Applicant: International Packaging Innovations, LLC, Tecumseh, MO (US)

(72) Inventor: Jeffrey Macler, Tecumseh, MO (US)

(73) Assignee: International Packaging Innovations, LLC, Tecumseh, MO (US)

( * ) Notice: Subject to any disclaimer, the term of this patent is extended or adjusted under 35 U.S.C. 154(b) by 0 days.

(21) Appl. No.: 13/738,725

(22) Filed: Jan. 10, 2013

(65) Prior Publication Data

US 2013/0186910 A1 Jul. 25, 2013

Related U.S. Application Data

(63) Continuation-in-part of application No. 13/446,386, filed on Apr. 13, 2012, now Pat. No. 8,464,906, and a continuation of application No. 11/691,974, filed on Mar. 27, 2007, now Pat. No. 8,177,096.

(51) Int. Cl.
*B67D 1/00* (2006.01)

(52) U.S. Cl.
USPC ..... 222/85; 222/1; 222/83; 222/83.5; 222/105; 222/185.1; 222/325; 222/485.1

(58) Field of Classification Search
USPC ..... 222/1, 80–83, 83.5, 85–88, 90, 105, 222/481.5, 181.1, 325, 183, 185.1; 239/272; 141/309, 329–330; 604/183, 604/86, 411, 414, 415; 206/524.8, 428, 206/524.3, 524.6
See application file for complete search history.

(56) References Cited

U.S. PATENT DOCUMENTS

| | | | | |
|---|---|---|---|---|
| 1,316,122 | A | 9/1919 | Vall | |
| 1,364,889 | A | 1/1921 | Rupp | |
| 1,889,557 | A | 4/1932 | Lange | |
| 2,655,286 | A * | 10/1953 | Barbaro | 222/82 |
| 2,825,334 | A | 3/1958 | Kas, Sr. | |
| 2,986,142 | A | 5/1961 | Bieberdorf | |
| 3,092,106 | A * | 6/1963 | Butler | 604/251 |
| 3,239,104 | A | 3/1966 | Scholle | |
| 3,435,990 | A | 4/1969 | Pike, Jr. | |
| 3,587,934 | A * | 6/1971 | Elmore | 222/171 |

(Continued)

FOREIGN PATENT DOCUMENTS

| | | |
|---|---|---|
| CA | 1229073 | 8/1985 |
| CA | 1192164 | 11/1987 |

(Continued)

OTHER PUBLICATIONS

"JARCO: Server Express Rectangular Stainless, Model 07020," http://www.concessionstands/com/itemdesc.asp?Cartid=8002691GSS-EVEREST-VO750 . . . , printed on Oct. 22, 2004, p. 1-2.

(Continued)

*Primary Examiner* — Frederick C Nicolas
(74) *Attorney, Agent, or Firm* — Lewis, Rice & Fingersh, L.C.

(57) ABSTRACT

A spike for dispensing fluids from a flexible bag, wherein the spike includes multiple fluid channels which transfer liquids from the bag to an enclosed dispensing chamber and air from the enclosed chamber to the bag to permit and control fluid flow within the system.

12 Claims, 3 Drawing Sheets

(56) References Cited

U.S. PATENT DOCUMENTS

| | | | | |
|---|---|---|---|---|
| 3,688,950 | A | 9/1972 | Parish | |
| 3,813,009 | A | 5/1974 | Lenz | |
| 3,848,776 | A | 11/1974 | Schieser | |
| 4,150,744 | A | 4/1979 | Fennimore et al. | |
| 4,293,081 | A * | 10/1981 | Kuckens | 222/83 |
| 4,296,786 | A * | 10/1981 | Brignola | 141/309 |
| 4,322,465 | A | 3/1982 | Webster | |
| 4,449,631 | A | 5/1984 | Levenberg et al. | |
| 4,527,716 | A * | 7/1985 | Haas et al. | 222/83.5 |
| 4,548,605 | A | 10/1985 | Iwamoto et al. | |
| 4,561,560 | A | 12/1985 | Lyon | |
| 4,755,292 | A | 7/1988 | Merriam | |
| 4,793,514 | A | 12/1988 | Sheets | |
| 4,801,007 | A | 1/1989 | Rule | |
| 4,846,236 | A | 7/1989 | Deruntz | |
| 4,865,218 | A | 9/1989 | Derby et al. | |
| 4,936,829 | A | 6/1990 | Zdeb et al. | |
| 5,049,129 | A | 9/1991 | Zdeb et al. | |
| 5,141,134 | A | 8/1992 | Machado | |
| 5,217,118 | A | 6/1993 | Mochizuki et al. | |
| 5,224,619 | A | 7/1993 | Dilworth et al. | |
| 5,251,786 | A | 10/1993 | Sarrine | |
| 5,270,219 | A | 12/1993 | DeCastro et al. | |
| 5,281,027 | A | 1/1994 | Thrall | |
| 5,358,501 | A | 10/1994 | Meyer | |
| 5,405,053 | A * | 4/1995 | Zublin | 222/83.5 |
| D361,838 | S | 8/1995 | Kuhn et al. | |
| 5,551,606 | A | 9/1996 | Rai et al. | |
| 5,567,322 | A | 10/1996 | Rundle et al. | |
| 5,573,047 | A | 11/1996 | Akin | |
| 5,645,913 | A | 7/1997 | Rogers | |
| 5,691,015 | A | 11/1997 | Tsukamoto et al. | |
| 5,944,232 | A | 8/1999 | Hestehave et al. | |
| 5,967,197 | A | 10/1999 | Shown | |
| 6,026,988 | A | 2/2000 | Teetsel, III et al. | |
| 6,095,433 | A | 8/2000 | Langdon | |
| 6,098,844 | A * | 8/2000 | Nicolle | 222/80 |
| 6,116,467 | A | 9/2000 | Petriekis | |
| 6,149,034 | A | 11/2000 | Amberg et al. | |
| 6,207,046 | B1 | 3/2001 | Yamashita et al. | |
| 6,223,940 | B1 * | 5/2001 | Quinn | 222/81 |
| 6,253,961 | B1 * | 7/2001 | Anderson et al. | 222/83 |
| 6,386,392 | B1 | 5/2002 | Argentieri et al. | |
| 6,398,073 | B1 * | 6/2002 | Nicolle | 222/67 |
| 6,442,960 | B1 | 9/2002 | Fournier et al. | |
| 6,557,735 | B1 | 5/2003 | Stray | |
| 6,613,036 | B1 | 9/2003 | Farmer et al. | |
| 6,685,056 | B1 * | 2/2004 | Argentieri et al. | 222/83.5 |
| 6,726,061 | B2 | 4/2004 | Good | |
| 7,331,487 | B2 * | 2/2008 | Macler et al. | 222/83 |
| 8,177,096 | B2 * | 5/2012 | Macler | 222/85 |
| 8,464,906 | B2 * | 6/2013 | Macler | 222/1 |
| 2005/0092769 | A1 | 5/2005 | Macler, II et al. | |
| 2007/0154119 | A1 | 7/2007 | Macler et al. | |

FOREIGN PATENT DOCUMENTS

| | | |
|---|---|---|
| CN | 98213085.6 | 6/1999 |
| CN | 98215293.3 | 7/1999 |
| CN | 99209220.5 | 4/2000 |
| CN | 99246066.2 | 9/2000 |
| CN | 99246067.0 | 9/2000 |
| CN | 99254569.2 | 2/2001 |
| CN | 00237624.5 | 5/2001 |
| CN | 00237625.3 | 7/2001 |
| CN | 03209721.2 | 8/2004 |
| CN | 03231908.8 | 8/2004 |
| CN | 03231906.1 | 9/2004 |
| CN | 03210115.5 | 10/2004 |
| CN | 200320100534.9 | 3/2005 |
| CN | 200410052994.8 | 3/2005 |
| CN | 200410067280.4 | 3/2005 |
| CN | 200420005755.2 | 3/2005 |
| CN | 200420037745.7 | 7/2005 |
| CN | 200420107401.9 | 11/2005 |
| EP | 0250640 | 1/1988 |
| FR | 2685293 | 6/1993 |

OTHER PUBLICATIONS

"RTM Restaurant Group—Cryovac Division of Seal Air Case History," http://www.sealedair.com/library/casehit/rtm_resthtml, printed on Oct. 22, 2004, p. 1-5.

"Sealed Air Corporation, Cryovac to Showcase the Advantage and Efficiencies for Flexible Packaging at IEFP Booth #E7612," http://pelv2003.packexop.com,/pelv2003/packaging_suppliers/ve/pr/33953/970.html, printed on Oct. 22, 2004, p. 1-3.

"Condiment Pumps—Server Express System," http://www.server-products.com/sepouch.htm, printed on Oct. 22, 2004, p. 1-3.

International Search Report, International Patent Application No. PCT/US07/72766, mailed on Apr. 11, 2008, 9 pages.

* cited by examiner

MULTIPLE CHANNEL SINGLE SPIKE FOR A LIQUID DISPENSING SYSTEM

CROSS REFERENCE TO RELATED APPLICATION(S)

This application is a Continuation-in-Part of U.S. Utility application Ser. No. 13/446,386 filed Apr. 13, 2012, which is a Continuation of U.S. Utility application Ser. No. 11/691,974 filed Mar. 27, 2007. The entire disclosure of all of these documents is herein incorporated by reference.

BACKGROUND

1. Field of the Invention

This disclosure relates to systems for dispensing liquids from bags, in particular to a liquid dispensing system wherein liquid is dispensed from a bag via a puncturing device utilizing a single spike having a plurality of channels.

2. Description of the Related Art

Conventional domestic liquid dispensers used primarily for providing heated or cooled water are usually free standing devices which dispense sterilized or mineral water from large rigid water bottles. The rigid water bottles have a large body portion and a narrow neck portion having a mouth opening, and are coupled to a water dispenser by inverting the bottle and positioning the mouth of the bottle in a chamber of the water dispenser. Air, introduced into the water bottle through the mouth, allows water to be dispensed from the inverted bottle until the water level in the chamber reaches the mouth of the bottle. Since the water bottle is rigid, once the water level in the chamber reaches the mouth of the bottle no more air can enter the bottle, so water remaining in the inverted bottle is retained in the bottle due to the difference between the air pressure external to the inverted bottle and the air pressure inside the bottle.

Water is then dispensed from the chamber through a conduit attached to a valve at the opposite end of the chamber from the mouth of the water bottle. When the level of water in the chamber falls below the mouth of the water bottle, air enters the water bottle, allowing water to flow from the bottle until the water level in the chamber again reaches the mouth of the bottle.

Although conventional domestic water dispensers are widely used, they are deficient in a number of respects. First, water bottles used in the conventional domestic water dispensers usually contain a large quantity of sterilized water, typically on the order of about five (5) gallons. A gallon of water weighs about 8.39 pounds, and thus a full five gallon bottle weighs well in excess of forty (40) pounds. Due to the weight and size of a bottle holding that amount of water, it is often difficult to invert and properly locate the mouth of the bottle in the chamber without spilling a quantity of the water.

Second, to prevent water from continuously flowing from the water bottle while the water bottle is inverted, the water bottles used with such water dispensers are fabricated from a thick, rigid, plastic material that can hold a vacuum without collapsing. Such bottles are expensive and due to their cost, are usually resterilized and reused after an initial use. Because the bottles are rigid and enclosed, they are not collapsible or stackable, and require a great deal of space to transport, driving up the cost of shipping the empty water bottle back to the supplier for sterilization and reuse. These costs are adsorbed by the consumer through increased water costs.

Third, in order for the mouth of the water bottle to be positioned in the chamber of the cooler, the water bottles must have a neck, as described above. The presence of the neck, however, increases the difficulty in sterilizing the water bottles, since the neck may limit the ability of the sterilizing agents to reach all the interior parts of the bottle, even when large quantities of sterilizing agents are used. While the use of heat sterilization could overcome this problem to some extent, it is generally not possible to use heat sterilization on plastic bottles. Although sterilization using ultraviolet light is possible, ultraviolet light sterilization may lead to incomplete sterilization. Particularly troublesome, once the bottle is inverted into the fluid dispenser, the outside of the neck of the bottle can contact the fluid, and it is very difficult to maintain this area of the bottle sterile.

Fourth, with the necessity of sterilizing the water bottles after each use, over time the rigid plastic water bottles may develop cracks or holes. If such failures occur while the water bottle is inverted in the water dispenser, air will enter the water bottle and allow water to flow uncontrollably from the mouth of the water bottle, allowing the chamber eventually to overflow. This water overflow can expose the purchaser's premises to the risk of water damage.

One solution to the problem of potential chamber overflow, and the necessity to make bottles of rigid materials to allow for the pressure differential described above, is to add a valve in the flow path between the bottle and the chamber. Such a valve allows the flow of water out of the bottle to be closed off so that the chamber does not overflow. Such a valve can operate automatically, opening and closing depending on the level of the fluid in the chamber A more recent development in fluid dispensing systems has been to utilize bags rather than bottles to transport and dispense water from an otherwise conventional fluid dispensing system ("office cooler"). Such a system is described in U.S. patent application Ser. No. 10/940,057 to Macler, et al., for example, the entire disclosure of which is incorporated herein by reference. The Macler application offers a device that dispenses fluid from a disposable or recyclable bag, and thereby affords some of the benefits associated therewith.

As described in the Macler application, however, to overcome the problem of over flowing the chamber since a collapsible bag cannot hold a reduced pressure headspace (as a rigid bottle does), the device described therein uses a vent to permit and control flow between the bag and the chamber. The vent runs parallel to the cooler's vertical axis, into which water flows when water is dispensed until the water level in the vent is level with the water level in the cooler. Such a vent straw equalizes the pressure within the bag with the ambient pressure.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein, among other things, is a spike for dispensing a liquid from a bag, the spike comprising: a shaft comprising a proximal and distal end and an elongated body therebetween and having an outer surface; a puncturing tip at the distal end; a first channel internal to the shaft, the first channel having a first fluid inlet on the puncturing tip through which fluid can flow through the first channel when a bag of fluid is punctured by the puncturing tip; a second channel internal to the spike, the second channel being noncontiguous with the first channel and having a second fluid inlet on the outer surface below the first fluid inlet through which fluid can flow through the second channel when a bag of fluid is punctured by the puncturing tip; a first aperture at the proximal end allowing fluid to flow through the first channel; a second aperture at the proximal end further from the distal end than the first aperture, the second aperture allowing fluid to flow through the second channel.

In an embodiment, the spike further comprises: a puncturing tip comprising: a generally cone-shaped portion having a base and an opposing truncated tip, the base being sized and shaped for attaching to the first end of the shaft and being attached to the first end; a puncturing shaft having two opposing ends and an elongated body therebetween, a first end of the two opposing ends being sized and shaped to attach to the truncated tip and the first end attached to the truncated tip, and a second end of the two opposing ends being a generally cone-shaped element sized and shaped for puncturing a collapsible bag of liquid.

In an embodiment, the puncturing shaft is generally cylindrical.

In an embodiment, the puncturing shaft is generally a polygonal prism.

In an embodiment, the puncturing shaft is generally a hexagonal prism.

In an embodiment, the shaft is generally cylindrical.

In an embodiment, the shaft is generally a polygonal prism.

In an embodiment, the shaft is generally a hexagonal prism.

In an embodiment, the spike further comprises: the shaft further comprising a generally cylindrical hollow extension having an aperture at each of two opposing ends allowing fluid to flow through the extension, a first end of the two opposing ends being attached to the shaft such that the aperture in the first end generally circumscribes the second fluid inlet.

10. Also described herein, among other things, is a liquid dispensing system comprising: a dispensing base; an enclosed chamber positioned interior to the dispensing base; a support external to the dispensing base, the support providing support for a bag containing liquid; a single spike comprising a plurality of noncontiguous internal channels, the single spike being situated to puncture the bag containing liquid when the bag containing liquid is supported by the support and wherein the plurality of noncontiguous internal channels provide continuity of air and fluid flow between the enclosed chamber and the bag containing liquid upon puncturing the bag containing liquid; and, a dispensing valve connected to the enclosed chamber allowing for dispensing liquid from the enclosed chamber.

Also described herein, among other things, is a method for dispensing liquid from a collapsible bag containing liquid, the method comprising the steps of: providing a bag support capable of supporting a collapsible bag containing liquid during dispensing of liquid from the bag and having a supporting surface defining a first space adjacent to a first side of the supporting surface and defining a second space on a second side of the supporting surface opposite the first side, the second space being an enclosed chamber; providing a single spike comprising a puncturing tip and a plurality of noncontiguous internal channels, each channel of the plurality of noncontiguous internal channels having a plurality of apertures on the exterior surface of the spike allowing fluid to flow through the each channel, the single spike connected to the enclosed chamber such that the puncturing tip can puncture a collapsible bag containing liquid supported by the bag support, and a first aperture of the plurality of apertures of the each channel is in the second space; supporting a collapsible bag containing liquid with the bag support; puncturing the collapsible bag containing liquid with the single spike such that a second aperture of the plurality of apertures of the each channel is in the collapsible bag containing liquid and liquid flows from the collapsible bag into the enclosed chamber through a first channel of the plurality of noncontiguous channels and air flows from the second space into the collapsible bag through a second channel of the plurality of noncontiguous channels; dispensing liquid from the collapsible bag containing liquid.

In an embodiment, the method further comprises the steps of: providing a dispensing valve connected to the second space; opening the dispensing valve to cause liquid to flow from the second space through the dispensing valve and to cause liquid to flow from the collapsible bag containing liquid into the second space; dispensing liquid from a collapsible bag containing liquid.

DESCRIPTION OF THE PREFERRED EMBODIMENT(S)

It is understood by one of ordinary skill in the art that while this disclosure focuses on water storage and delivery, it pertains to any liquid that needs to be transported in bulk, kept free from contamination, and dispensed in smaller quantities than that in which it is transported.

Figure 1:
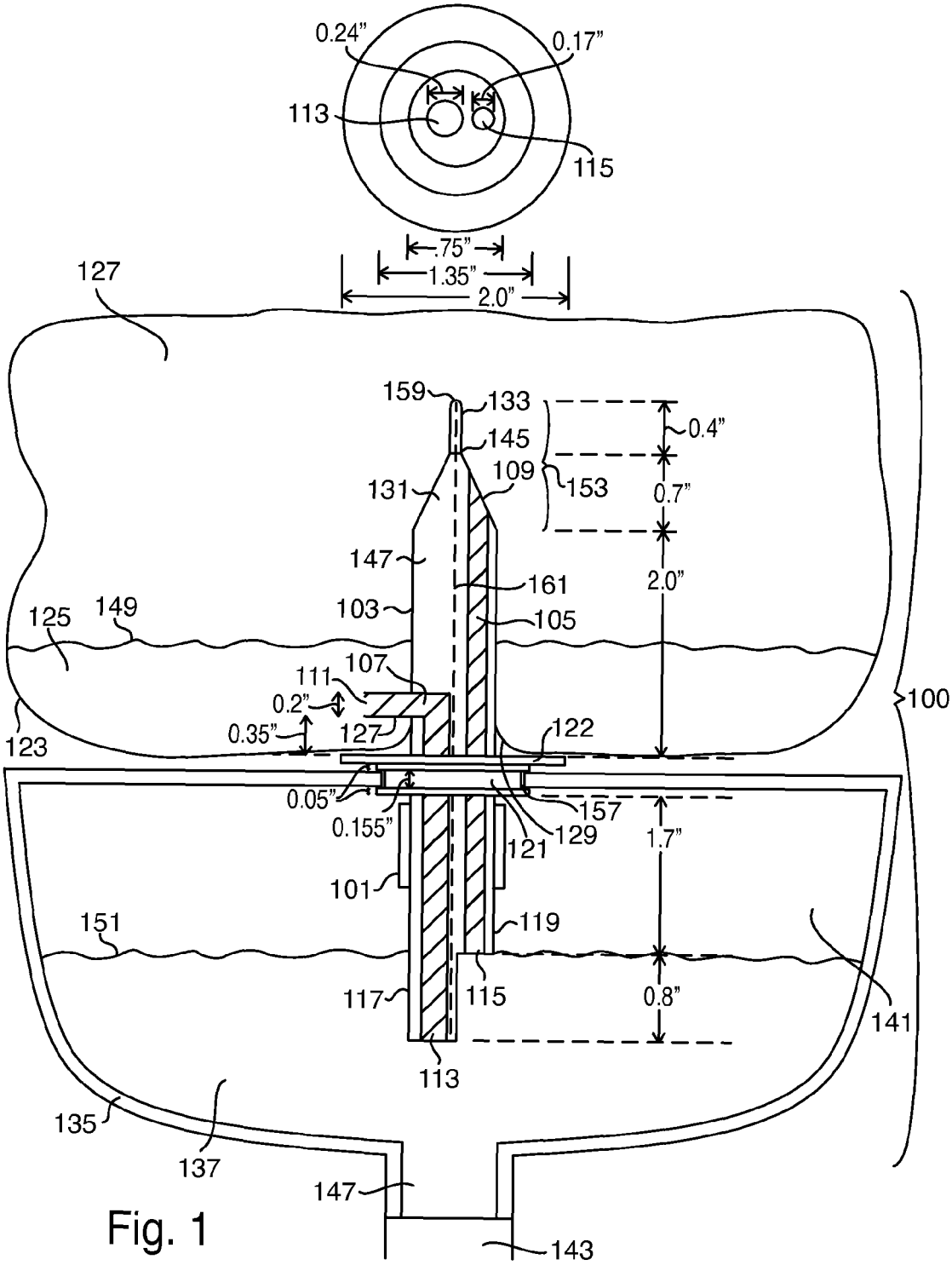
FIG. 1 provides a side elevation view of one embodiment of a multi-path single spike used with a fluid dispensing system.

In the depicted embodiment of FIG. 1, a multi-channel single spike (101) is used in a fluid dispensing system (100) to permit and control fluid flow in the system (100) from a collapsible bag (123). One of ordinary skill in the art will understand the term "fluid" as used herein to include liquids and gases. One of ordinary skill in the art will further understand the term "channel" as used herein to refer to an enclosed path or passageway through a solid and having a plurality of access points. One of ordinary skill in the art will further understand the terms "inlet" and "outlet" as used herein to refer to an access path to a channel for both ingress and egress, and to be used to describe an intended flow of fluid in the system for purposes of clarity and understanding, but these terms should not be understood as limiting fluid flow to any one direction. One of ordinary skill in the art will further understand the term "enclosure" as used herein to mean a solid material generally defining an interior space within said solid, and that this term does not imply or suggest that such interior space is completely sealed off; indeed, an "enclosure" as used herein may have one or more apertures or access points.

The depicted system (100) generally includes an enclosed chamber (135), a multi-channel single spike (101), a collapsible bag (123) containing liquid (125), and a dispensing valve (143). The spike (101) is comprised of a generally cylindrical shaft (103) and a disc-shaped gasket (121) sealedly attached thereto. In an alternative embodiment, the body of the spike may be in a shape other than cylindrical, such as a polygonal prism. In an embodiment, the shaft (103) is in the shape of a hexagonal prism.

The gasket (121) is attached to the shaft (103) such that the center of the gasket (121) is generally collinear with the major axis (161) of the shaft (103), and the major axis (161) of the shaft (103) is generally perpendicular to the radius of the gasket (121), and the gasket (121) circumscribes the shaft (103). In an embodiment, the gasket (121) and shaft (103) are monolithically constructed. In an alternative embodiment, the gasket (121) and shaft (103) are constructed separately and affixed together through any method suitable to maintain the mating under the pressures in the system (100), including, without limitation through heat molding and the use of adhesives.

The gasket (121) is generally disc-shaped or ring-shaped and is generally sized and shaped for sealedly attaching the spike (101) to the chamber (135) to establish a snug, airtight fit. In the depicted embodiment, the gasket (121) has a radius greater than that of the shaft (103), but an alternative embodiment, the gasket (121) may have a radius less than or the same as that of the shaft (103). In the depicted embodiment, the radius of the gasket (121) is about double the radius of the shaft (103). The configuration of the gasket (121), including without limitation its radius and thickness, may depend upon the size and shape of the opening (157) in the chamber (135). The gasket (121) may be made from any non-permeable material sufficiently rigid to maintain its own shape and withstand the fluid pressure and vacuum forces in the system (100), such as glass, porcelain, ceramics, synthetic moldable organic solids, polymers, plastics, rubber and the like.

In the depicted embodiment of FIG. 1, the gasket (121) is attached to the chamber (135) such that the major axis (161) is parallel to the force of gravity and the puncturing tip (159) of the spike (101) is oriented upward so that a collapsible bag (123) may be dropped or lowered onto the puncturing tip (159) with the assistance of gravity. The gasket (121) is sealedly attached to the chamber (135), such as by plugging a top opening (157) in the chamber in generally airtight fashion, or being monolithically constructed with same chamber. The gasket (121) may be attached to the chamber (135) by heat molding, adhesive, or any other method suitable for use in conjunction with the forces at work in the system (100). In an embodiment, the radius of the gasket (121) is larger than the radius of the top opening (157). In the depicted embodiment, the gasket (121) is sized and shaped to couple with the opening (157) in the chamber (135).

The spike (101) further includes a second, rigid gasket (122) located generally adjacent to the gasket (121). The diameter of the rigid gasket (122) is generally larger than that of both the shaft (103) and of the coupling gasket (121), such that the lower surface of the rigid gasket (122) rests against or near the top of the chamber (135) when the spike (101) has been installed in the chamber (135). Because the diameter of the rigid gasket (122) is generally larger than that of the opening (157) the rigid gasket (122) provides additional airtight and watertight sealing to the system (101). The large surface area of the rigid gasket (122) also provides a smooth and generally uniform surface to support the punctured (129) portion of the bag (123), creating a "stopping distance" for the bag (123) when lowered onto the spike (101).

The spike (101) includes a generally cylindrical shaft (103) having a smooth surface and two opposing ends extending generally collinearly in opposing directions from the gasket (121) such that the major axis (161) of the shaft (103) is generally perpendicular to the gasket (121) and the gasket (121) circumscribes the shaft (103). When the spike (101) is installed in the chamber (135), the upward end of the spike (101) includes a puncturing portion (153) and the lower end of the spike (101) includes a dispensation enclosure (117) and a vent enclosure (119). The length of the shaft (103) is generally sufficiently long to establish a watertight seal with the bag and to locate the inlets and outlets within the bag (123) when the bag (123) is punctured, as described elsewhere herein, but short enough that the shaft does not pierce another surface of the bag (123), such as the opposite end from the punctured point.

The puncturing portion (153) comprises a truncated cone-shaped portion (131) attached to the shaft (103) such that the base (147) of the cone-shaped portion (131) is attached to the end of the shaft (103) distal from the gasket (121). In the depicted embodiment, the diameter of the base (147) of the cone-shaped portion (131) is generally the same as the diameter (147) of the shaft (103) and the cone-shaped portion (131) is attached to the shaft (103) such that the center axis of the cone-shaped portion (131) is generally collinear with the center axis (161) of the shaft. The tip (145) of the cone-shaped portion (131) is truncated generally parallel to the base (147), having a flat, circular surface.

The spike (101) further includes a generally cylindrical second shaft (133) attached to the tip (145) of the truncated cone-shaped portion (131). The diameter of the second shaft (133) is generally the same as the diameter of the tip (145) of the truncated cone-shaped portion (131), and the second shaft (133) is attached to the tip (145) such that the center axis of the second shaft (131) is generally collinear with the center axis of the main shaft (103) and of the truncated cone-shaped portion (131). The diameter of the second shaft (133) is less than that of the main shaft (103).

The distal end of the second shaft (133) includes a puncturing tip (159) for puncturing a collapsible bag (123) of liquid (125). The puncturing tip (159) of the depicted embodiment is generally a truncated cone-shaped element and is attached to the second shaft (133) such that the base (145) of the puncturing tip (159) is attached to the top of the second shaft (133). In the depicted embodiment, the diameter of the base (145) of the puncturing tip (159) is generally the same as the diameter of the second shaft (133) and the puncturing tip (159) is attached to the second shaft (133) such that the center axis of the puncturing tip (159) is collinear with the center axis (161) of the shaft (103). In the depicted embodiment, the puncturing tip (159) is generally a truncated cone-shaped element having a narrow, flat top, but in an alternative embodiment, the puncturing tip (159) is pointed or bladed. In an embodiment, the puncturing portion (153) is monolithically constructed, such as from a single block of material, or a single work piece. In another embodiment, the puncturing portion (153) and shaft (103) are monolithically constructed.

In the depicted embodiment, the portion of the shaft (103) extending below the gasket (121) includes a dispensing enclosure (117) and a venting enclosure (119). When the spike (101) is attached to the top opening (157) in the chamber (135), the dispensing enclosure (117) extends further into the chamber (135) than does the venting enclosure (119). The dispensing enclosure (117) encloses a hollow dispensing channel (107), and the venting enclosure (119) encloses a hollow venting channel (105). The venting channel (105) and dispensing channel (107) are non-contiguous with each other within the spike (101).

The dispensing enclosure (117) and the venting enclosure (119) are each generally in the shape of a half cylinder mutually attached at the bases and each having generally the same radius. In an alternative embodiment, enclosures (117 and 119) are sized and shaped differently, including without limitation having different radii, such as to regulate and facilitate the amount, rate, or type of fluid that flows through each. The combination of the dispensing enclosure (117) and venting enclosure (119) forms a generally cylindrical shaft. The diameter of the cylinder formed by the combination of the dispensing enclosure (117) and the venting enclosure (119) is generally the same as that of the main shaft (103). In an embodiment, the diameter of the cylinder formed by the venting enclosure (119) and dispensing enclosure (117) may be larger or smaller than that of the main shaft, but generally will be smaller than that of the gasket (121) and the rigid gasket (122). In an embodiment, the combination of the dispensing enclosure (117) and venting enclosure (119) forms a generally cylindrical shaft at the gasket (121), but one of the two enclosures (117 and 119) is longer than the other, resulting in the generally cylindrical shaft becoming a generally half-cylindrical shaft at the distal end from the gasket (121). In an alternative embodiment, the shaft (103) does not have a gasket. In a still further embodiment, the shaft (103) includes one or more tabbed protrusions gasket sized and shaped for coupling to and/or interlocking with the chamber (135).

In the depicted embodiment, the venting channel (105) is a generally cylindrical passageway extending through the spike (105) and having an air inlet (115) at the distal end of the venting enclosure (119) through which air (141) in the chamber (135) may enter the venting channel (105) and having an air outlet (109) above the gasket (121) through which air in the venting channel (105) may enter the collapsible bag (123). In the depicted embodiment, the venting channel (105) is generally a straight channel through the spike (101) running generally parallel to the center axis (161) of the spike (101) and not necessarily collinear with the center axis (161) of the spike (101), but rather offset from the center axis (161) of the spike (101) such that the center axis (161) of the spike (101) is not within the venting channel (105).

In the depicted embodiment, the air outlet (109) is an aperture in the outer surface of the truncated cone-shaped portion (131) of the puncturing portion (153), but in an alternative embodiment, the air outlet (109) may be located elsewhere on a surface of the shaft (103) or puncturing portion (153), generally above the gasket (121). It is preferred that the air outlet (109) be located in such a manner as not to compromise the structural integrity of the spike (101), and that the air outlet (109) be sized and shaped to permit an effective amount of air to egress the venting channel (105) at an effectively airflow rate to permit and control the flow of fluids (125) in the system (100) as elsewhere described herein and in the incorporated references.

The dispensing channel (107) is a generally cylindrical passageway extending through the spike (101) and having a liquid inlet (111) above the gasket (121) through which liquid (125) in the bag (123) may enter the dispensing channel (107), and having a liquid outlet (113) at the distal end of the dispensing enclosure (117) through which liquid in the dispensing channel (107) may enter the chamber (135). In the depicted embodiment, the dispensing channel (107) is a generally straight channel extending through the spike (101) to a point above the gasket (121), at which point the dispensing channel (107) turns at approximately a ninety degree) (90°) angle and proceeds generally away from the center axis (161) of the spike (101) and through a fluid inlet enclosure (127) attached to the outer surface of the shaft (103). In the depicted embodiment, the fluid inlet (111) is an aperture in the distal end of the fluid inlet enclosure (127) distal from the shaft (103). The portion of the dispensing channel (107) from the liquid outlet (113) to the fluid inlet enclosure (127) is generally a straight channel through the spike (101) running generally parallel to the center axis (161) of the spike (101) and generally not collinear with the center axis (161) of the spike (101), but rather offset from the center axis (161) of the spike (101) such that the center axis (161) of the spike (101) is not within the dispensing channel (105). In a still further embodiment, channels (105 and 107) may be arranged differently. By way of example and not limitation, channels (105 and 107) may be arranged in a V-shaped orientation.

In the depicted embodiment, the fluid inlet (111) is an aperture in the fluid inlet enclosure (127) and the fluid inlet enclosure (127) is located near the gasket (121). This has the advantage of minimizing waste liquid in the system (100). In an alternative embodiment, the fluid inlet (111) may be located elsewhere above the gasket (121), or include or use different structure not depicted in FIG. 1. In an embodiment, the spike (101) does not include a fluid inlet enclosure (127). For example, in the alternative embodiment of FIG. 2, the fluid inlet (111A) may be an aperture in the outer surface of the shaft (103), or may be an aperture (111B) in the outer surface of the truncated cone-shaped (131) portion of the puncturing portion (153). It is preferred that the fluid inlet (111) be located in such a manner as not to compromise the structural integrity of the spike (101), and that the fluid inlet (111) be sized and shaped to permit an effective amount of liquid to ingress the dispensing channel (107) at an effective flow rate to permit and control the flow of fluid in the system (101) as elsewhere described herein and in the incorporated references.

Figure 2:
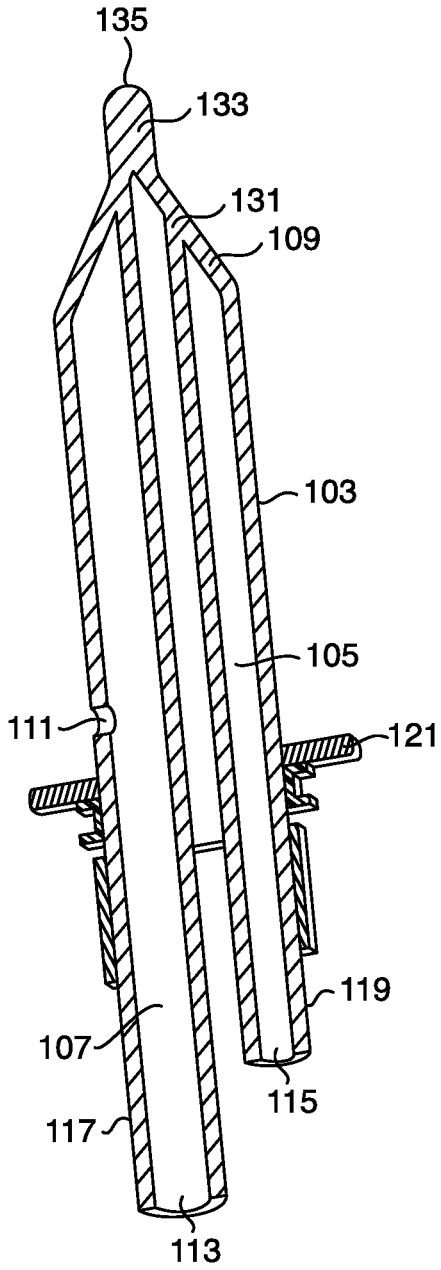
FIG. 2 provides a cross-section side view of an alternative embodiment of a multi-path single spike.

In the depicted embodiment of FIG. 1, the dispensing enclosure (117) and venting enclosure (119) are contiguous, but in an alternative embodiment, such as the alternative embodiment of FIG. 2, the dispensing enclosure (117) and venting enclosure (119) are non-contiguous.

In an embodiment, there may be a plurality of inlets or outlets for one or both of the channels (117 and 119). In a still further embodiment, the spike (101) may enclose still further channels (not depicted) in addition to channels (117 and 119). Although the channels are generally described as cylindrical, the channels are sized and shaped to facility the flow of fluid in the system and may have other configurations or shapes, including, without limitation, polygonal prisms.

In the depicted embodiment, the bag (123) of liquid (125) is suspended from a support (not depicted) and dropped onto the spike (101) so that the puncturing tip (159) punctures the outer surface of the bag (123) and the spike (101) penetrates the bag (123). The spike (101) need only penetrate the bag (123) such that the liquid inlet (111) and gas outlet (109) are within the interior space of the bag (123), though the spike will generally penetrate the bag (123) such that the punctured portion (129) of the bag (123) is on or near the rigid gasket (122).

In the preferred embodiment, the bag (123) is made from a material with inherent elastic and tensile properties. Some suitable materials are described in the '096 patent to Macler. As the puncturing is performed, the puncturing tip (159) creates a small hole or tear from the outer surface to the inner surface of the bag (123). This hole (129) is generally similarly sized and shaped as the puncturing tip (159). In an embodiment, the opening (129) in the bag (123) is gradually enlarged as the bag (123) is pushed over the puncturing portion (153) and onto the shaft (103).

In an alternative embodiment, the opening (129) does not enlarge significantly. In such an embodiment, as the bag (123) is pushed onto the spike (101), the spike (101) the portion of the bag (123) forming the hole (129) circumscribes the second shaft (133). When the hole (129) reaches the truncated cone-shaped portion (131), the material forming the hole (129) stretches around the increasing circumference of the truncated cone-shaped portion (131), but the hole (129) generally does not tear or enlarge because of the elastic properties of the material of the bag (123). This stretching in turn generates tensile force exerted by the bag (123) material on the portion of the spike (101) with which the hole (129) is in contact, improving the watertight seal between the bag (123) and the spike (101). When the bag (123) has been lowered into proper position unto the spike (101), the material forming the hole (129) in the bag (123) is stretched to about the circumstance of the shaft (103).

Figure 3:
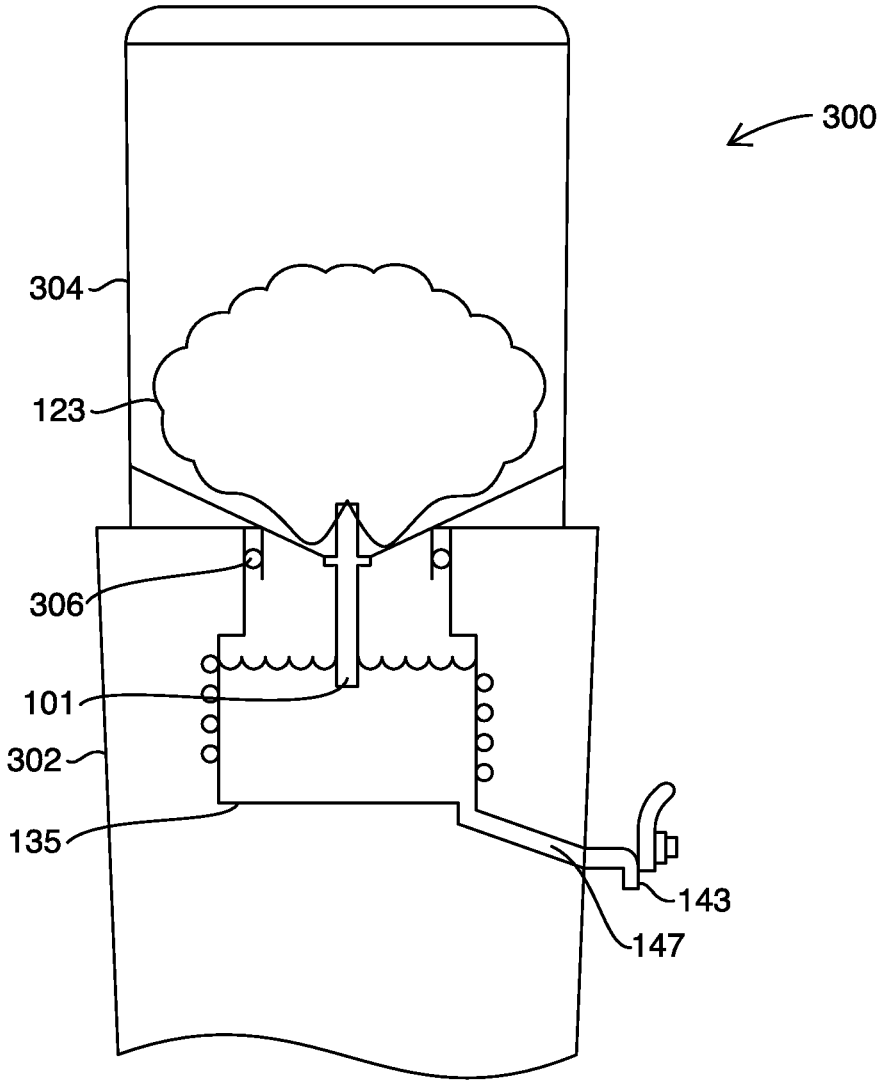
FIG. 3 provides a cross-sectional view of an embodiment of a liquid dispensing system using an embodiment of a multi-path single spike.

The chamber (135) is generally contained within a supporting structure such a water cooler (300) as in FIG. 3. The chamber (135) is generally internally sanitized and sterilized. In the depicted embodiments of FIGS. 1 and 3, the chamber (135) is connected to a dispensing valve (143) through a dispensing channel (147). When the dispensing value (143) is actuated, water flows out of a spigot or similar dispensing structure. Because the dispensing channel (147) is connected to the chamber (135), the departure of liquid (137) from the dispensing channel (147) in turn causes the liquid level (151) in the chamber (135) to decrease.

As described elsewhere herein, the spike (101) is positioned with respect to the chamber (135) such that the ventral portion of the spike (101) below the gasket (121) is generally within the interior portion of the chamber (135), and the connection between the spike (101) and chamber (135) is generally airtight and watertight. The interior of the bag (123) is also generally sanitized and sterilized. Thus, when the bag (123) is punctured, the combination of the bag (123), spike (101), and chamber (135) create a generally internally sealed, sanitary, sterilized, airtight, and watertight system. In the depicted embodiment, the dispensing enclosure (117) extends further into the chamber (135) than does the venting enclosure (119). This allows air (141) to be forced into the venting enclosure (119) to maintain proper pressure within the system (100), as described elsewhere herein. The length of the enclosures (117 and 119) will generally be such that both enclosures (117 and 119) terminate within the chamber (135) and do not contact any interior surface of the chamber (135), allowing fluid to ingress and/or egress the channels (107 and 105) via the inlets (113 and 115).

The chamber (135) may be of any shape or size. In an embodiment, a system for heating or cooling the liquid in the chamber (135) is included, and the chamber (135) will be sized and shaped to accommodate such a system, and to hold a sufficient amount of cooled or heated liquid (137) to provide an adequate supply or cooled and/or heated liquid for the particular environment in which the device will be used.

In the depicted embodiment of FIG. 1, the liquid channel (107) is larger in diameter than the airflow chamber (105), and the flow rate for water (125) from the bag (123) to the chamber (135) is higher than the flow rate of air (141) from the chamber (135) to the bag (123). This configuration both permits appropriate fluid flow within the system aprevents "chugging," whereby water (125) from the bag (123) drains into the chamber (135) in a fitful, start-and-stop manner as the air pressure between the bag (123) and chamber (135) rapidly oscillates between equalized and unequalized, which in turn causes noise, vibration, and erratic dispensing behavior.

The liquid inlet (111) is generally closer to the rigid gasket (122) than the top opening (109) for the airflow chamber (105) so that, among other things, more water (125) in the bag (123) can flow into the chamber (135). That is, once the water level (149) in the bag (123) is below the liquid inlet (111), there will be no liquid (125) in the bag (123) capable of entering the fluid flow chamber (107) because the waterline (149) in the bag (123) is below the opening (111). While some water (148) might be splashed into the fluid flow chamber (107) through the opening (111), such as by shaking or jostling the water cooler (300), this is not preferred and may result in damage to the system. Thus, to the extent that water (125) remains in the bag (123) at a level (149) below that of the liquid inlet (111), that water (125) is generally not able to be dispensed by the system (100). At this point, the bag (123) is effectively empty and should be replaced. The closer that the liquid inlet (111) is to the rigid gasket (121), the less the amount of wasted water (125) there will be in the bag (123) when the bag (123) is effectively empty.

The dispensation enclosure (117) generally extends further into the chamber (135), than the vent enclosure (119), as illustrated in FIG. 1, although both enclosures (117 and 119) are part of a single shaft. When the bag (123) is initially punctured and situated such that fluid flow out of the bag is encouraged by gravity, pressure, or any other means, fluid (125) in the bag (123) enters holes (111 and 109) in both channels (105 and 107). The chamber (135), closed at the spigot (143), fills with fluid (137) released through both channels (107 and 109). However, it will generally occur primarily through the dispensation channel (107) which is generally adapted to permit water flow more easily than does the venting channel (105).

As liquid continues to flow from the bag (123) into the chamber (135), the level (151) of liquid contained in the chamber (135) continues to rise. Water (137) in the chamber (135) will displace the air (141) in the chamber (135), forcing the air (141) to seek escape from the chamber (135). The only opening not effectively blocked with water (137) is vent channel (105), which will result in air (141) generally passing upward through channel (105) and with some air passing through channel (107). Fluid and air flow generally continues through both channels (105 and 07) until the liquid (137) in the chamber (135) accumulates to the point of reaching the terminus (113) of the dispensation channel (107) at which point air (141) can no longer flow into dispensation channel (107). As water will, however, continue to flow as there is no vacuum in the bag (123), air (141) will be forced in greater amount up the vent channel (105). Once the water reaches the bottom of the vent channel (105), the air (141) can no longer escape from chamber (135). At that point, some air (141) remains in the chamber (135). Water (137) will continue to flow into the chamber (135) which will pressurize the air (141) remaining, which cannot escape, as the water (137) level (151) in the chamber (135) continues to increase. Eventually, this pressure will equal that exercised by gravity and external pressure on the water (125) feeding the chamber (135), and water flow will cease as the pressure equalizes.

Upon the puncturing of a sealed bag (123) by the spike (101), the fluid path out of the chamber (135) through the spike (101) has become sealed relative to the ambient environment external to the system (100). That is, after the puncturing of the bag (123), there is no connection between the external environment and the chamber (135). The vent channel (105) then becomes the only passage through which to equalize the pressure between the chamber (135) and vents air (141) into the bag (123).

Thus, if the pressure in the chamber (135) is less than the pressure exerted by the bag (123), liquid continues to flow into the chamber (135). The pressure in the chamber (135), however, begins to rise. Liquid flows into the chamber (135) and the pressure in the chamber (135) rises until the point where the pressure in the chamber (135) equals the water pressure from the bag (123). At this point, flow from the bag (123) into the chamber (135) will stop as pressure equalizes.

Now with liquid (137) in the chamber (135), the same liquid (137) can be dispensed through the dispensing valve (143). When the dispensing valve (143) is opened to allow liquid (137) to be dispensed from the chamber (135), the water level (151) in the chamber (135) decreases, until eventually the liquid level (151) in the chamber (135) is lower than the inlet (115) of the vent channel (105). During dispensing, the pressure in the chamber (135) is reduced from the value at equilibrium (no flow), thus allowing liquid (125) to again begin to flow from the bag (123) into the chamber (135). So long as the volume liquid flow through channels (105 and 107) are less than the volume liquid flow through the dispensing valve (143), the liquid level (151) in the chamber (135) continues to decrease as the liquid (137) continues to be dispensed. So long as the volume rate of flow out of the dispensing valve (143) (i.e., out of the chamber (135)) is greater than the combined volume rate of flow into the chamber (135) through the dispensation channel (107), the pressure in the chamber (135) will also continue to decrease.

When the dispensing valve (143) is finally closed, the reduced pressure in the chamber (135) will add to the total force working to move liquid from the bag (123) into the chamber (135). Not only will gravity be pulling the liquid through the dispensation channel (107), but also pressure external to the bag (123) will be pushing the liquid (125) through the dispensation channel (107) into the chamber (135). Such a chamber (135) in which pressure is reduced during dispensing is beneficial to the evacuation of liquid (125) from the bag (123) to the greatest extent, since, in effect, the reduced pressure in the chamber (135) results in a greater net force working to push liquid (125) out of the bag (123). As stated above, these forces will work to move liquid (125) from the bag (123) into the chamber (135) until all forces are equilibrated. In the event that the liquid (125) in the bag (123) is exhausted, the vacuum in the chamber (135) will generally pull air (127) from the bag (123) into the chamber (135), collapsing the bag (123) and draining any remaining water into the dispensation channel (107).

In a case where a new bag (123) full of liquid (125) is punctured by the spike (101), it is possible that there will be a transient increase in pressure in the chamber (135), especially if the bag (123) is dropped onto the spike (101), as in the preferred embodiment.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A spike for dispensing a liquid from a bag, the spike comprising:

a shaft comprising a proximal and distal end and an elongated body therebetween and having an outer surface;

a puncturing tip at said distal end;

a first channel internal to said shaft, said first channel having a first fluid inlet on said puncturing tip through which fluid can flow through said first channel when a bag containing a fluid is punctured by said puncturing tip;

a second channel internal to said spike, said second channel being noncontiguous with said first channel and having a second fluid inlet on said outer surface below said first fluid inlet through which said fluid in said bag can flow through said second channel when said bag is punctured by said puncturing tip;

a first aperture at said proximal end allowing said fluid to flow through said first channel;

a second aperture at said proximal end further from said distal end than said first aperture, said second aperture allowing said fluid to flow through said second channel.

2. The spike as claimed in claim 1, said spike further comprising:

said puncturing tip comprising:

a generally cone-shaped portion having a base and an opposing truncated tip, said base being sized and shaped for attaching to said first end of said shaft and being attached to said first end;

a puncturing shaft having two opposing ends and an elongated body therebetween, a first end of said two opposing ends being sized and shaped to attach to said truncated tip and said first end attached to said truncated tip, and a second end of said two opposing ends being a generally cone-shaped element sized and shaped for puncturing a collapsible bag of liquid.

3. The spike as claimed in claim 2, wherein said puncturing shaft is generally cylindrical.

4. The spike as claimed in claim 2, wherein said puncturing shaft is generally a polygonal prism.

5. The spike as claimed in claim 4, wherein said puncturing shaft is generally a hexagonal prism.

6. The spike as claimed in claim 1, wherein said shaft is generally cylindrical.

7. The spike as claimed in claim 1, wherein said shaft is generally a polygonal prism.

8. The spike as claimed in claim 7, wherein said shaft is generally a hexagonal prism.

9. The spike as claimed in claim 1, wherein said spike further comprises:

said shaft further comprising a generally cylindrical hollow extension having an aperture at each of two opposing ends allowing fluid to flow through said extension, a first end of said two opposing ends being attached to said shaft such that said aperture in said first end generally circumscribes said second fluid inlet.

10. A liquid dispensing system comprising:

a dispensing base;

an enclosed chamber positioned interior to said dispensing base;

a support external to said dispensing base, said support providing support for a bag containing liquid;

a single spike comprising a plurality of noncontiguous internal channels, said single spike being situated to puncture said bag containing liquid when said bag containing liquid is supported by said support and wherein said plurality of noncontiguous internal channels provide continuity of air and fluid flow between said enclosed chamber and said bag containing liquid upon puncturing said bag containing liquid; and, a dispensing valve connected to said enclosed chamber allowing for dispensing liquid from said enclosed chamber.

11. A method for dispensing liquid from a collapsible bag containing liquid, said method comprising the steps of:

providing a bag support capable of supporting a collapsible bag containing liquid during dispensing of liquid from said bag and having a supporting surface defining a first space adjacent to a first side of said supporting surface and defining a second space on a second side of said supporting surface opposite said first side, said second space being an enclosed chamber;

providing a single spike comprising a puncturing tip and a plurality of noncontiguous internal channels, each channel of said plurality of noncontiguous internal channels having a plurality of apertures on the exterior surface of said spike allowing fluid to flow through said each channel, said single spike connected to said enclosed chamber such that said puncturing tip can puncture said collapsible bag containing liquid supported by said bag support, and a first aperture of said plurality of apertures of said each channel is in said second space;

supporting said collapsible bag containing liquid with said bag support;

puncturing said collapsible bag containing liquid with said single spike such that a second aperture of said plurality of apertures of said each channel is in said collapsible bag containing liquid and said liquid flows from said collapsible bag into said enclosed chamber through a first channel of said plurality of noncontiguous channels and air flows from said second space into said collapsible bag through a second channel of said plurality of noncontiguous channels;

dispensing said liquid from said collapsible bag containing liquid.

12. The method as claimed in claim 11, said method further comprising the steps of:

providing a dispensing valve connected to said second space;

opening said dispensing valve to cause said liquid to flow from said second space through said dispensing valve and to cause said liquid to flow from said collapsible bag containing liquid into said second space;

dispensing said liquid from said collapsible bag containing liquid.

* * * * *